US009864395B1

(12) United States Patent
Prochazka et al.

(10) Patent No.: US 9,864,395 B1
(45) Date of Patent: Jan. 9, 2018

(54) BASE CURRENT COMPENSATION FOR A BJT CURRENT MIRROR

(71) Applicants: STMicroelectronics Design and Application S.R.O, Prague (CZ); STMicroelectronics Asia Pacific Pte Ltd, Singapore (SG)

(72) Inventors: Roman Prochazka, Struharov (CZ); Chee Weng Cheong, Singapore (SG)

(73) Assignees: STMicroelectronics Asia Pacific Pte Ltd, Singapore (SG); STMicroelectronics Design and Application S.R.O., Prague (CZ)

( * ) Notice: Subject to any disclaimer, the term of this patent is extended or adjusted under 35 U.S.C. 154(b) by 0 days.

(21) Appl. No.: 15/367,628

(22) Filed: Dec. 2, 2016

(51) Int. Cl.
*G05F 3/26* (2006.01)

(52) U.S. Cl.
CPC ..... *G05F 3/267* (2013.01)

(58) Field of Classification Search
CPC ..... G05F 3/267
USPC ..... 323/315
See application file for complete search history.

(56) References Cited

U.S. PATENT DOCUMENTS 4,853,610 A * 8/1989 Schade, Jr. ..... G05F 3/267 323/316
2010/0244808 A1* 9/2010 Marinca ..... G05F 3/30 323/315
2015/0253799 A1 9/2015 Cheong et al.
2016/0342172 A1* 11/2016 Bai ..... G05F 3/267

OTHER PUBLICATIONS

Daly, James C. et al: "Analog BiCMOS Design Practices and Pitfalls," CRC Press, 2000, Chapter 3.1 (21 pages).

* cited by examiner

*Primary Examiner* — Jeffrey Sterrett
(74) *Attorney, Agent, or Firm* — Gardere Wynne Sewell LLP

(57) ABSTRACT

A current mirror circuit includes an input current leg and an output current leg. The input current leg includes: a first bipolar junction transistor (BJT) having a collector terminal configured to receive an input current sourced at a current node and a first metal oxide semiconductor field effect transistor (MOSFET) having a gate terminal coupled to the current node and a source terminal coupled to a base terminal of the first BJT. The output current leg includes: a second BJT having a collector terminal configured to supply an output current and a second MOSFET having a gate terminal coupled to the current node and a source terminal coupled to a base terminal of the second BJT.

18 Claims, 6 Drawing Sheets

BASE CURRENT COMPENSATION FOR A BJT CURRENT MIRROR

TECHNICAL FIELD

The present invention relates to current mirroring circuits and, in particular, to a current mirror circuit using bipolar junction transistors (BJTs) with base current compensation.

BACKGROUND

FIG. 1 shows a circuit diagram for a conventional current mirror circuit 10. The circuit includes an input current leg 12 and at least one output current leg 14. A current source 16 generates an input current Iin that is applied to the input current leg 12. The input current Iin is mirrored over to the output current leg 14 where an output current Iout is generated. The ratio of the magnitude of the output current to the input current is referred to as the mirroring ratio.

The circuit 10 is implemented using bipolar junction transistors (BJTs). The input current leg 12 includes a first BJT device 20 that is configured as a diode-connected device. The collector terminal of the first BJT device 20 is electrically coupled to the base terminal of the first BJT device 20, and the collector terminal of the first BJT device 20 is configured to receive the input current Iin from the current source 16. The emitter terminal of the first BJT device 20 is electrically coupled to a reference voltage supply node. For example, the reference voltage supply node may comprise a ground (Gnd) voltage node. The output current leg 14 includes a second BJT device 22. The base terminal of the second BJT device 22 is electrically coupled to the base terminal of the first BJT device 20. The emitter terminal of the second BJT device 22 is electrically coupled to the reference voltage supply node. The output current Tout in the output current leg 14 is generated at the collector terminal of the second BJT device 22.

FIG. 2 shows a circuit diagram for a conventional current mirror circuit 30. The circuit 30 differs from the circuit 10 in that the output current leg 14 includes a plurality of parallel connected second BJT devices 22(1)-22(*n*) forming a variable output transistor 22*v*. The base terminals of the second BJT devices 22(1)-22(*n*) are electrically coupled to the base terminal of the first BJT device 20. The emitter terminals of the second BJT devices 22(1)-22(*n*) are electrically coupled to the reference voltage supply node. The collector terminals of the second BJT devices 22(1)-22(*n*) are electrically coupled to a common output current node 32 through respective switches 34(1)-34(*n*). The output current Iout in the output current leg 14 is generated at the common output current node 32 as a sum of the currents generated at the collector terminals of the second BJT devices 22(1)-22(*n*). The magnitude of the output current Tout is accordingly dependent on the number of second BJT devices 22(1)-22(*n*) that are actuated using the corresponding switches 34(1)-34(*n*) electrically coupled between the collector terminal and the common output current node 32. As an example, a multibit digital control signal D can be used to selectively actuate the switches 34(1)-34(*n*).

FIG. 3 shows a circuit diagram for a conventional current mirror circuit 50. The circuit 50 differs from the circuit 30 in that multiple output current legs 14(1)-14(*m*) are provided. Each output current leg 14(1)-14(*m*) includes a variable output transistor 22*v*. The base terminals of the variable output transistors 22*v*(1)-22*v*(*m*) are electrically coupled to the base terminal of the first BJT device 20. The emitter terminals of the variable output transistors 22*v*(1)-22*v*(*m*) are electrically coupled to the reference voltage supply node. Each common output current node 32(1)-32(*m*) generates a distinct output current Iout(1)-Iout(m) for a corresponding current channel CH(1)-CH(m).

In many applications, such as for the generation of a precise amount of charge, it is important to exercise accurate control over the magnitude of the output current Tout. This can be a challenge, however, when the value of the multibit digital control signal D changes and one or more of the output current legs 14(1)-14(*m*) of a given channel CH are deactuated. There is a charge injection to the potential at the base terminals (Vbase) that introduces an error in output current generation. There is accordingly a need in the art for active base current compensation for the current mirror circuits of the type shown in FIGS. 2 and 3.

SUMMARY OF THE INVENTION

It is to be understood that both the foregoing general description and the following detailed description are exemplary and explanatory and are intended to provide further explanation of the invention as claimed.

In an embodiment, a current mirror circuit comprises an input current leg and an output current leg. The input current leg includes: a first bipolar junction transistor (BJT) having a collector terminal configured to receive an input current sourced at a current node; and a first metal oxide semiconductor field effect transistor (MOSFET) having a gate terminal coupled to the current node and a source terminal coupled to a base terminal of the first BJT. The output current leg includes: a second BJT having a collector terminal configured to supply an output current; and a second MOSFET having a gate terminal coupled to the current node and a source terminal coupled to a base terminal of the second BJT.

BRIEF DESCRIPTION OF THE DRAWINGS

The accompanying drawings are included to provide a further understanding of the invention and are incorporated in and constitute a part of this specification, illustrate embodiments of the invention and together with the description serve to explain the principles of the invention.

In the drawings.

DETAILED DESCRIPTION

Figure 1:
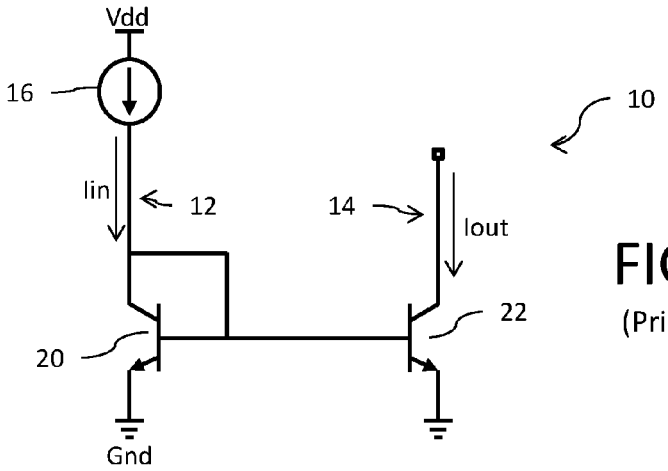
FIG. 1 (Prior Art)
FIGS. 1-3 are circuit diagrams for conventional current mirror circuits.
Figure 2:
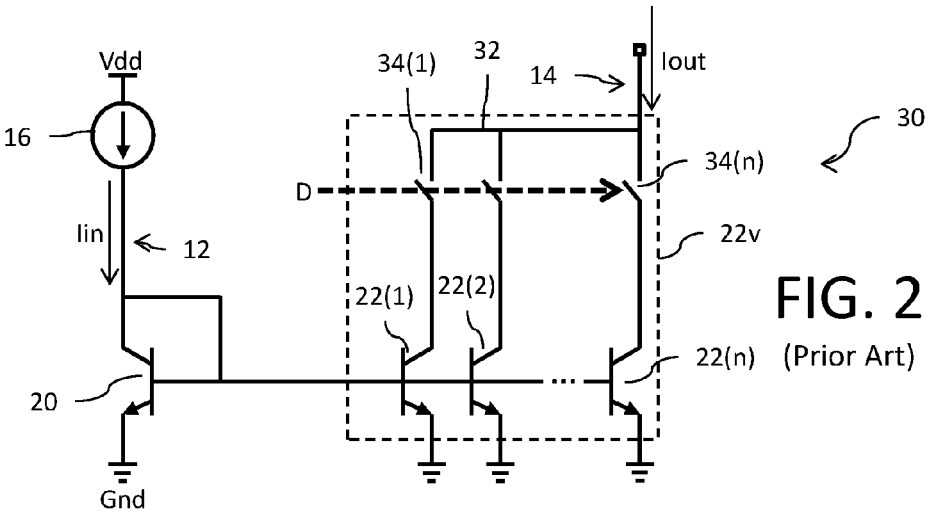
FIG. 2 (Prior Art)
Figure 3:
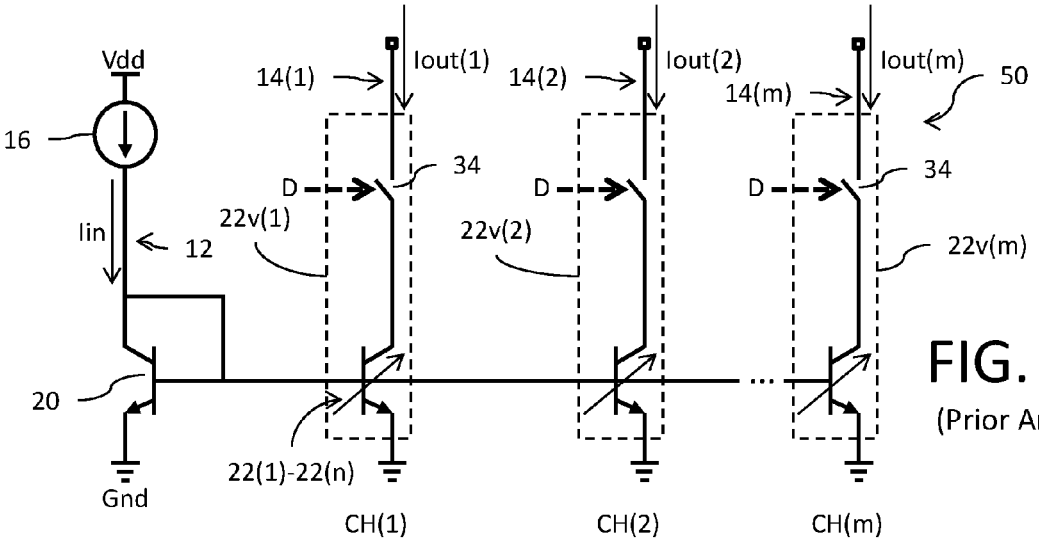
FIG. 3 (Prior Art)
Figure 4:
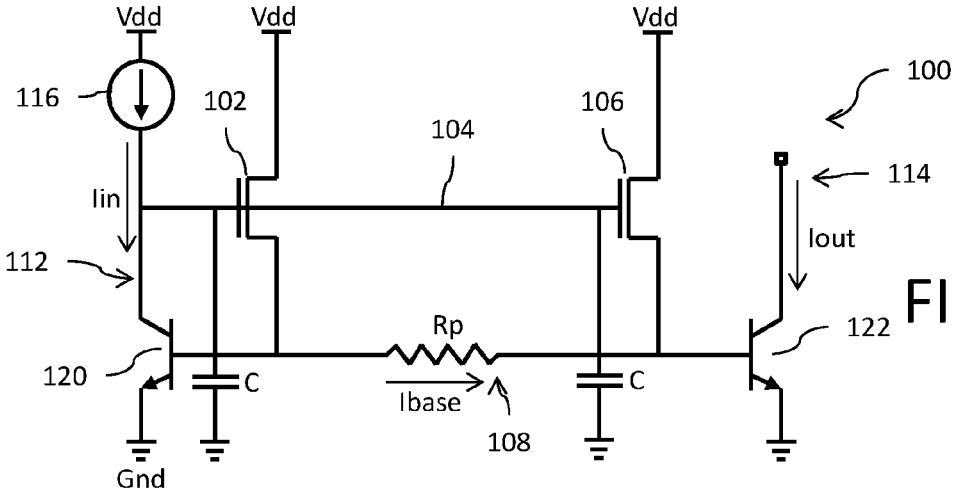
FIGS. 4-7, 9 and 11-12 are circuit diagrams for a bipolar junction transistor (BJT) current mirror with base current compensation.

Reference is now made to FIG. 4 showing a circuit diagram for a current mirror circuit 100. The circuit 100 includes an input current leg 112 and at least one output current leg 114. A current source 116 generates an input current Iin that is applied to the input current leg 112. The input current Iin is mirrored over to the output current leg 114 where an output current Iout is generated. The ratio of the magnitude of the output current to the input current is referred to as the mirroring ratio.

The mirroring function of the circuit 100 is implemented using bipolar junction transistors (BJTs). The input current leg 112 includes a first BJT device 120. The collector terminal of the first BJT device 120 is configured to receive the input current Iin from the current source 116. The emitter terminal of the first BJT device 120 is electrically coupled to a reference voltage supply node. For example, the reference voltage supply node may comprise a ground (Gnd) voltage node. The output current leg 114 includes a second BJT device 122. The base terminal of the second BJT device 122 is electrically coupled to the base terminal of the first BJT device 120. The emitter terminal of the second BJT device 122 is electrically coupled to the reference voltage supply node. The output current Tout in the output current leg 114 is generated at the collector terminal of the second BJT device 122.

The collector terminal of the first BJT device 120 is electrically coupled to the base terminal of the first BJT device 120 through an n-channel metal oxide semiconductor field effect transistor (MOSFET) device 102. In particular, the gate terminal of MOSFET device 102 is electrically coupled to the collector terminal of the first BJT device 120 at a reference current node 104. The source terminal of MOSFET device 102 is electrically coupled to the base terminal of the first BJT device 120. The drain terminal of MOSFET device 102 is electrically coupled to a further reference voltage supply node. For example, the further reference voltage supply node may comprise a positive (Vdd) voltage node.

The collector terminal of the first BJT device 120 is further electrically coupled to the base terminal of the second BJT device 122 through an n-channel MOSFET device 106. In particular, the gate terminal of MOSFET device 106 is electrically coupled to the collector terminal of the first BJT device 120 at the reference current node 104. The source terminal of MOSFET device 106 is electrically coupled to the base terminal of the second BJT device 122. The drain terminal of MOSFET device 106 is electrically coupled to the further reference voltage supply node.

The resistor Rp on the transistor common base connection line 108 between the first BJT device 120 and the second BJT device 122 is a parasitic line resistance. Thus, it will be noted that source terminal of MOSFET device 102 is electrically coupled to the base terminal of the first BJT device 120 on one end of the parasitic line resistance (adjacent to base terminal of the first BJT device 120) while the source terminal of MOSFET device 106 is electrically coupled to the base terminal of the second BJT device 122 on an opposite end of the parasitic line resistance (adjacent to the base terminal of the second BJT device 122). This electric line interconnection may extend over a not-insignificant length in the physical circuit layout on substrate. In this context, a component is considered to be "adjacent" to the BJT device if it is closer in layout to that device than to another BJT device. For example, in the circuit layout the MOSFET device 102 is adjacent to BJT device 120 (BJT device 122 being further away) and MOSFET device 106 is adjacent to BJT device 122 (BJT device 120 being further away). So, the "adjacent" MOSFET device would be the MOSFET device that is closest in the physical circuit layout on substrate to the BJT device.

In an ideal scenario, the current Ibase in the transistor common base connection line 108 between the first BJT device 120 and the second BJT device 122 is zero. If the current Ibase is not zero, there is a corresponding voltage drop across the parasitic resistor Rp and voltage at the base of the first BJT device 120 and voltage at the base of the second BJT device 122 will differ. To ensure the zero base current Ibase=0 condition, the MOSFET device 102 and the MOSFET device 106 function to control substantially equal (i.e., same within +/−0.02%) base voltages for the BJT devices.

One or more capacitors C can be coupled between the reference current node 104 and the reference voltage supply node (Gnd). In a preferred embodiment, one capacitor is provided adjacent to the MOSFET device 102 and another capacitor is provided adjacent to the MOSFET device 106. In this context, a component is considered to be "adjacent" another component of the circuit if it is closer in layout to that component than to another similar component. So, the adjacent capacitor is the capacitor that is closest in the physical circuit layout on substrate to the MOSFET device.

Figure 5:
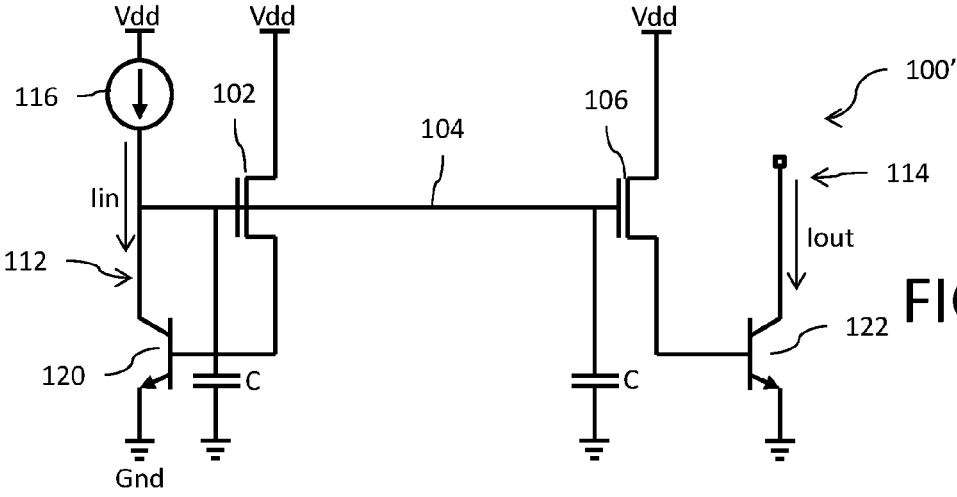

Reference is now made to FIG. 5 showing a circuit diagram for a current mirror circuit 100'. The circuit 100' is substantially similar in design to the circuit 100 of FIG. 4. The circuit 100' differs from the circuit 100 in that there is no transistor common base connection line 108. Nonetheless, the MOSFET device 102 and the MOSFET device 106 function to control substantially equal (i.e., same within +/−2.5%) base voltages for the BJT devices. In this implementation the devices 102 and 106 may be physically separated from each other by a not-insignificant distance in the physical circuit layout on substrate.

Figure 6:
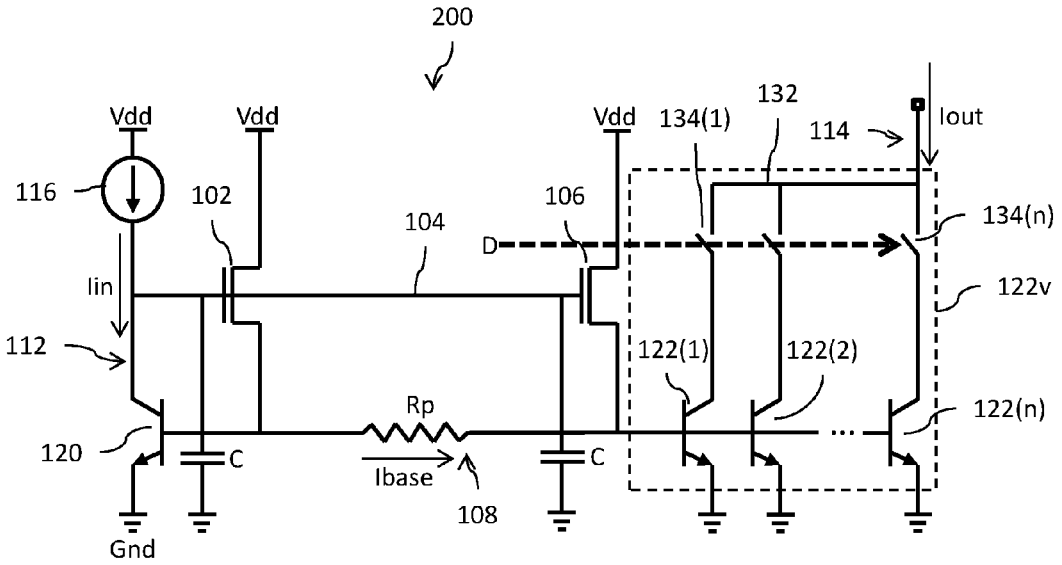

Reference is now made to FIG. 6 showing a circuit diagram for a current mirror circuit 200. The circuit 200 is substantially similar in design to the circuit 100 of FIG. 4. The circuit 200 differs from the circuit 100 in that the output current leg 114 includes a plurality of parallel connected second BJT devices **122(1)-122(*n*) forming a variable output transistor 122*v*. The base terminals of the second BJT devices 122(1)-122(*n*) are electrically coupled to the base terminal of the first BJT device 120. The emitter terminals of the second BJT devices 122(1)-122(*n*) are electrically coupled to the reference voltage supply node. The collector terminals of the second BJT devices 122(1)-122(*n*) are electrically coupled to a common output current node 132. The output current Tout in the output current leg 114 is generated at the common output current node 132 as a sum of the currents generated at the collector terminals of the second BJT devices 122(1)-122(*n*). The magnitude of the output current Tout is accordingly dependent on the number of second BJT devices 122(1)-122(*n*) that are actuated using the corresponding switches 134(1)-134(*n*) electrically coupled between the collector terminal and the common output current node 132. As an example, a multibit digital control signal D can be used to selectively actuate the switches 134(1)-134(*n*)**.

Figure 7:
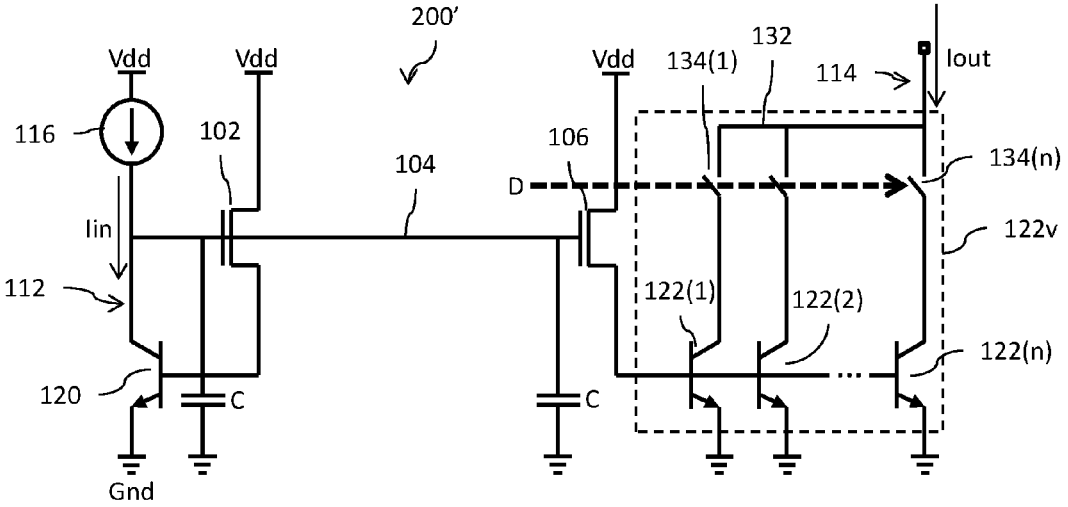

Reference is now made to FIG. 7 showing a circuit diagram for a current mirror circuit 200'. The circuit 200' is substantially similar in design to the circuit 200 of FIG. 6. The circuit 200' differs from the circuit 200 in that there is no transistor common base connection line 108. Nonetheless, the MOSFET device 102 and the MOSFET device 106 function to control substantially equal (i.e., same within +/−2.5%) base voltages for the BJT devices.

Figure 8:
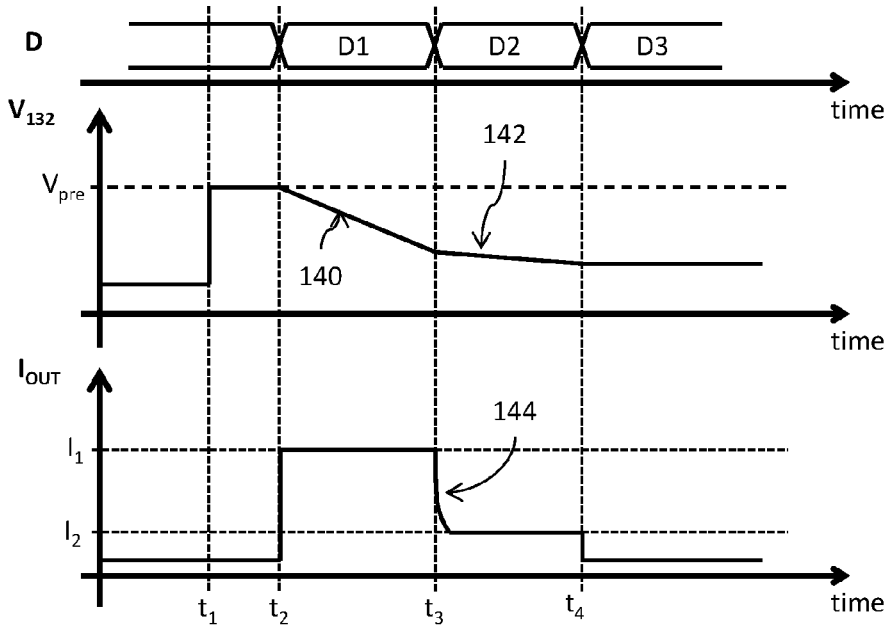
FIGS. 8 and 10 are waveform diagrams showing operation of the current mirror circuits.

Reference is now made to FIG. 8 showing a waveform diagram illustrating operation of the circuits of FIGS. 6-7. At time t1, the voltage at the common output current node 132 in the output current leg 114 is precharged to a desired voltage level Vpre. At time t2, the digital control signal D is set to a first digital value of D1. In response thereto, a first number of the switches **134(1)-134(*n*) are actuated. The currents flowing through the transistors 122(1)-122(*n*) in the corresponding actuated output legs 114(1)-114(*n*) are summed at the common output current node 132 to generate a first magnitude current I1 for the output current Tout. As a result of the generation of the output current Tout, the voltage at the common output current node 132 is discharged at a first rate 140. At time t3, the digital control signal D is set to a second digital value of D2. In response thereto, a second number of the switches 134(1)-134**(*n*), less than the first number, are actuated. So, certain ones of the switches 134 actuated at time t2 are deactuated at time t3. The currents flowing through the transistors 122(1)-122(*n*) in the corresponding actuated output legs 114(1)-114(*n*) are summed at the common output current node 132 to generate a second magnitude current I2 for the output current Tout that is less than the first magnitude current I1. As a result of the generation of the output current Tout, the voltage at the common output current node 132 is discharged at a second rate 142 that is less than the first rate 140. It will be noted that the transition in current magnitude at time t3 is not a step function (reference 144). The provision of the MOSFET device 102 and the MOSFET device 106 to control substantially equal base voltages for the BJT devices 120 and 122 helps to minimize the charge error produced as a result of switching off one or more of the transistors 122(1)-122(*n*) at time t3. At time t4, the digital control signal D is set to a third digital value of D3. In response thereto, the switches 134 (1)-134(*n*) are deactuated and the output current Iout goes to zero.

Figure 9:
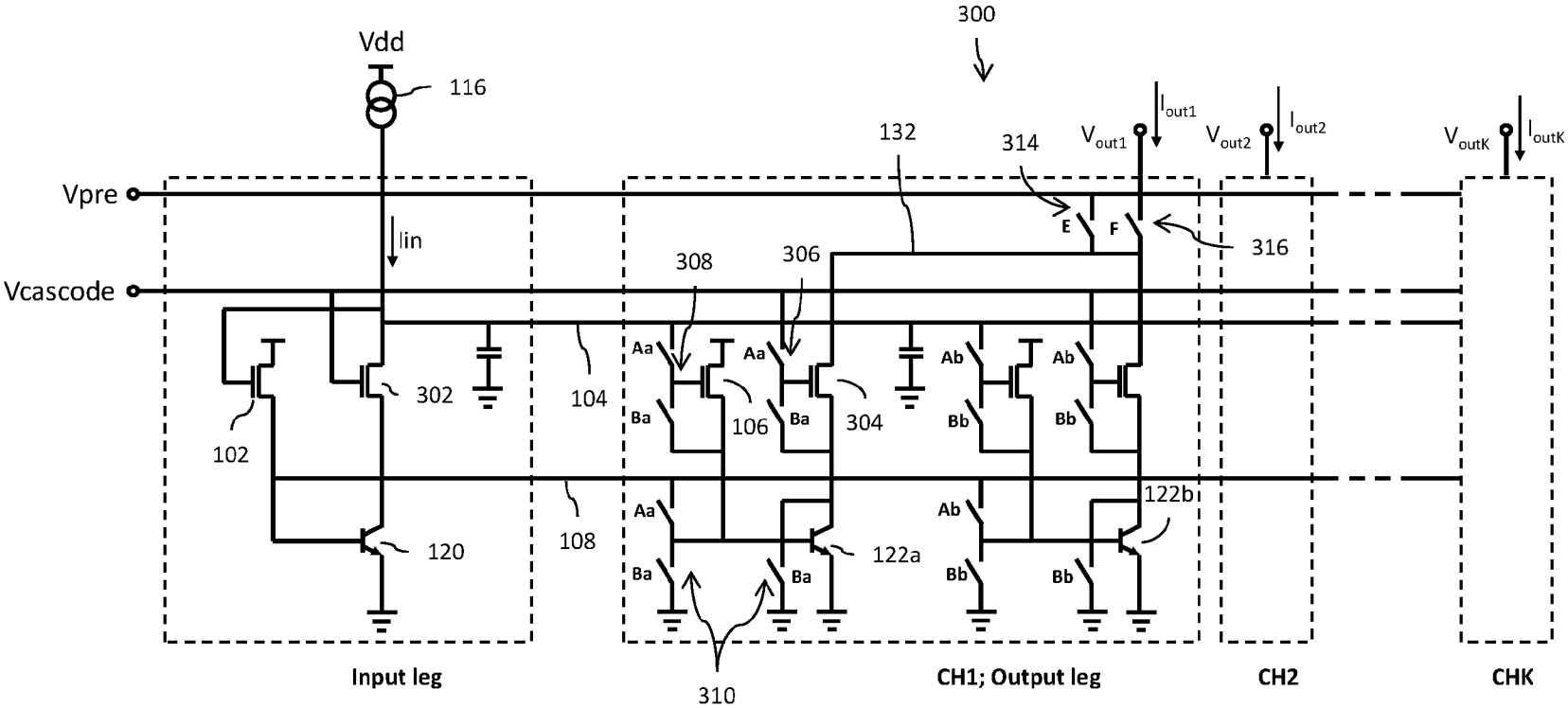

Reference is now made to FIG. 9 showing a circuit diagram for a current mirror circuit 300. The circuit 300 is similar in design to the circuit 200 of FIG. 6. The circuit 300 differs from the circuit 200 in the following ways:

With respect to the input leg, the circuit 300 further includes a cascode n-channel MOSFET transistor 302 whose source-drain path is coupled in series with the collector-emitter path of the first BJT device 120. The source terminal of transistor 302 is electrically coupled to the collector of transistor 120 and the drain terminal of transistor 302 is electrically coupled to the current source 126 to receive the input current Iin. The gate terminal of transistor 302 is coupled to receive a cascode bias voltage Vcascode. The cascode transistor 302 functions to set the same collector to emitter voltage across the BJT device 120 as collector to emitter voltage across the BJT device 122 set by cascode transistor 304.

With respect to each output leg, the circuit 300 further includes a cascode n-channel MOSFET transistor 304 whose source-drain path is coupled in series with the collector-emitter path of the second BJT device 122. The source terminal of transistor 304 is electrically coupled to the collector of transistor 122 and the drain terminal of transistor 304 is electrically coupled to the common output current node 132. The gate terminal of transistor 304 is driven by a switching circuit 306. The switching circuit 306 includes a first switch selectively actuated in response to signal A to couple the gate terminal of transistor 304 to the cascode bias voltage Vcascode and a second switch selectively actuated in response to signal B to couple the gate and source terminals of transistor 304 to each other. The MOSFET device 304 functions to increase output impedance of the current mirror which leads to lower sensitivity of the output current Tout on the current mirror output voltage Vout. When signal B is asserted and the second switch is turned on, the gate-to-source voltage Vgs of transistor 304 is zero and the device is effectively turned off.

Furthermore, the circuit 300 includes a switching circuit 308 to drive the gate terminal of transistor 106. The switching circuit 308 includes a first switch selectively actuated in response to signal A to couple the gate terminal of transistor 106 to the reference current node 104 and a second switch selectively actuated in response to signal B to couple the gate and source terminals of transistor 106 to each other. When signal B is asserted and the second switch is turned on, the gate-to-source voltage Vgs of transistor 106 is zero and the device is effectively turned off.

Still further, the circuit 300 includes a switching circuit 310 to drive the base terminal of transistor 122. The switching circuit 310 includes a first switch selectively actuated in response to signal A to couple the base terminal of transistor 122 to the common base connection line 108, a second switch selectively actuated in response to signal B to couple the base and emitter terminals of transistor 122 to each other at ground, and a third switch selectively actuated in response to signal B to couple the collector terminal of transistor 122 to ground. When signal B is asserted and the second and third switches are turned on, the base-to-emitter voltage Vbe of transistor 122 is zero, the collector is grounded, and the device is effectively turned off.

The circuit 300 also includes a switching circuit 314 comprising a switch to selectively couple the common output current node 132 to a precharge voltage Vpre. The switch of switching circuit 314 is selectively actuated in response to signal E.

The circuit 300 further includes a switching circuit 316 comprising a switch to selectively couple to the common output current node 132 for current output. The switch of switching circuit 316 is selectively actuated in response to signal F.

Each output current channel CH may include a plurality of parallel connected second BJT devices 122 forming the variable output transistor 122*v*. In the embodiment of FIG. 9, as an example, two second BJT devices 122*a* and 122*b* are provided. The control signals A and B for the switching circuits 306, 308 and 310 use a suffix identification (a or b) corresponding to the BJT device 122*a* or 122*b* to which the switching circuits are coupled. Thus, the control signals Aa and Ba control switches associated with the operation of the second BJT device 122*a* while control signals Ab and Bb control switches associated with the operation the second BJT device 122*b*.

Figure 10:
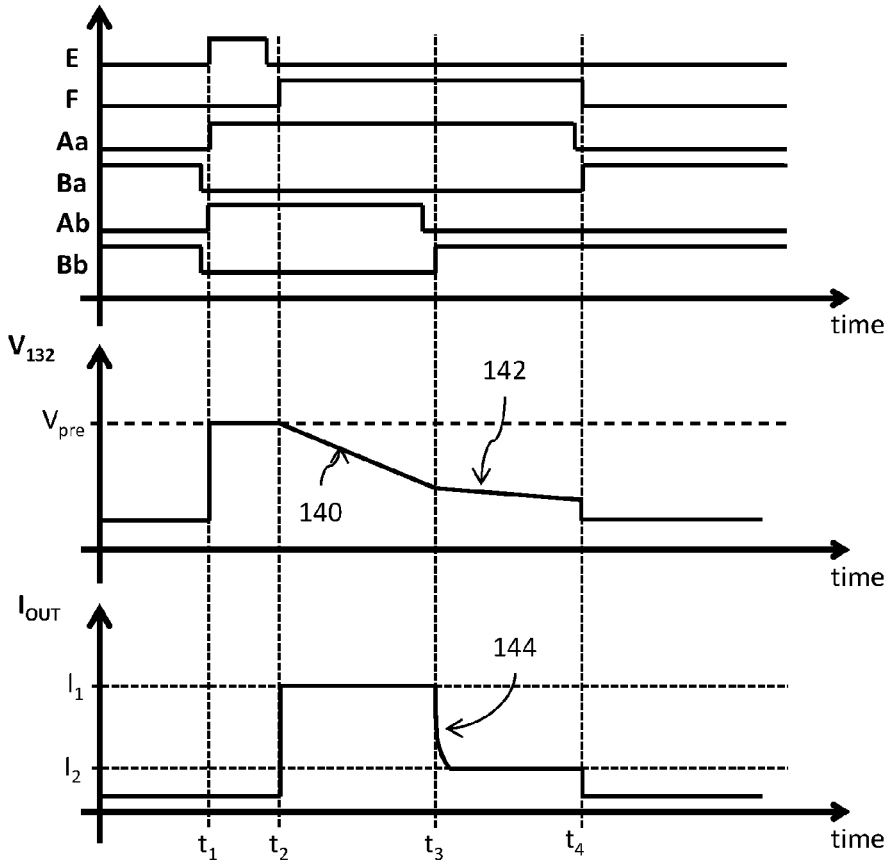

Reference is now made to FIG. 10 showing a waveform diagram illustrating operation of the circuits of FIG. 9. Prior to time t1, the signals Aa and Ab are deasserted and the signals Ba and Bb are asserted. The transistors 106, 122 and 304 are turned off. At time t1, signal E is asserted with a pulse to actuate switching circuit 314 and the voltage at the common output current node 132 in the output current leg 114 is precharged to a desired voltage level Vpre. At about this same time t1, the signals Aa and Ab are asserted and the signals Ba and Bb are deasserted to enable operation of the transistors 106, 122 and 304. It will be noted that the signals Aa/Ba and Ab/Bb are non-overlapping control signals to ensure that at no time are the switches simultaneously enabled. At time t2, the signal F is asserted to actuate switching circuit 316 and permit. Because both BJT device 122*a* or 122*b* are enabled, the currents flowing through the transistors 122*a* and 122*b* are summed at the common output current node 132 to generate a first magnitude current I1 for the output current Iout. As a result of the generation of the output current Iout, the voltage at the common output current node 132 is discharged at a first rate 140. At about time t3, the signal Ab is deasserted and the signal Bb is asserted. The transistor 122*b* is according disabled and its corresponding current is no longer supplied to the common output current node 132 and a second magnitude current I2 is generated for the output current Iout that is less than the first magnitude current I1. As a result, the voltage at the common output current node 132 is discharged at a second rate 142 that is less than the first rate 140. At about time t4, the signal Aa is deasserted and the signal Ba is asserted. The transistor 122*a* is according disabled and its corresponding current is no longer supplied to the common output current node 132. The signal F is also deaserted. The output current Iout accordingly goes to zero. The output voltage also falls at time t4. At time t4, node 132 becomes a high impedance node and the voltage at that node is not well defined. Rather, the voltage is mainly defined by actual circuit behavior in a fast transient condition. Charge injection of all components play a role there, but the final voltage on node 132 is not particularly important because switch 316 is turned off. The voltage Vout is affected by the capacitive external circuitry and thus the voltage will not drop all the way to zero.

It will be noted that the current mirror circuit can include a plurality of output current channels. The implementation of FIG. 9 shows K such output channels (CH1-CHK). Each output channel would have a same or similar circuit configuration as shown in detail with respect to channel CH1.

Figure 11:
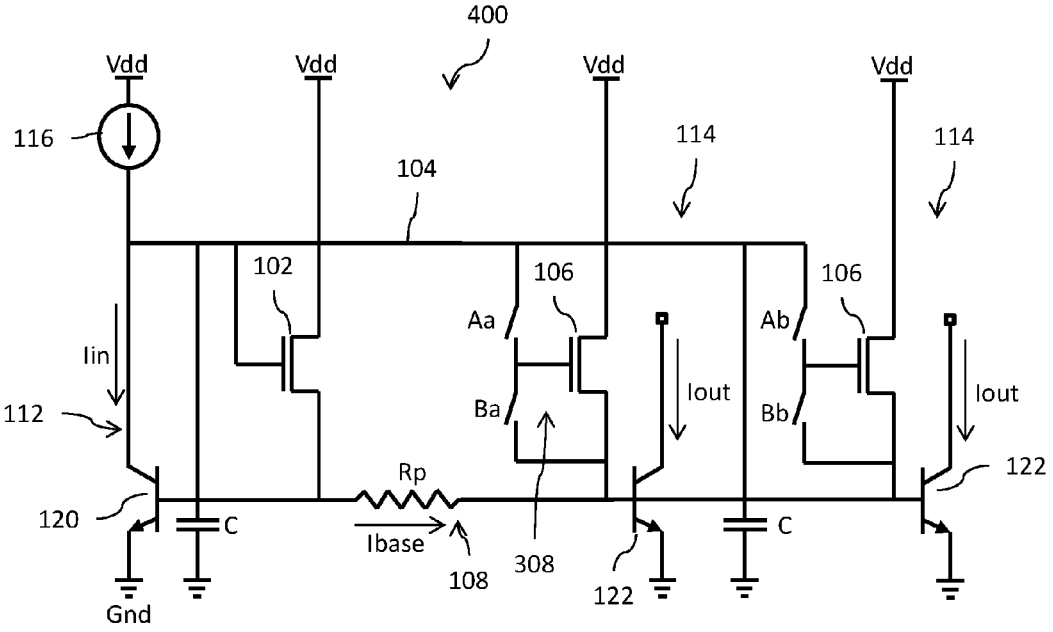

Reference is now made to FIG. 11 showing a circuit diagram for a current mirror circuit 400. The circuit 400 is substantially similar in design to the circuit 100 of FIG. 4. The circuit 400 differs from the circuit 100 in that it includes the switching circuit 308 for driving the gate terminal of the transistor 106 of each output leg. The configuration and operation of the switching 308 is described in detail in connection with FIG. 9.

Figure 12:
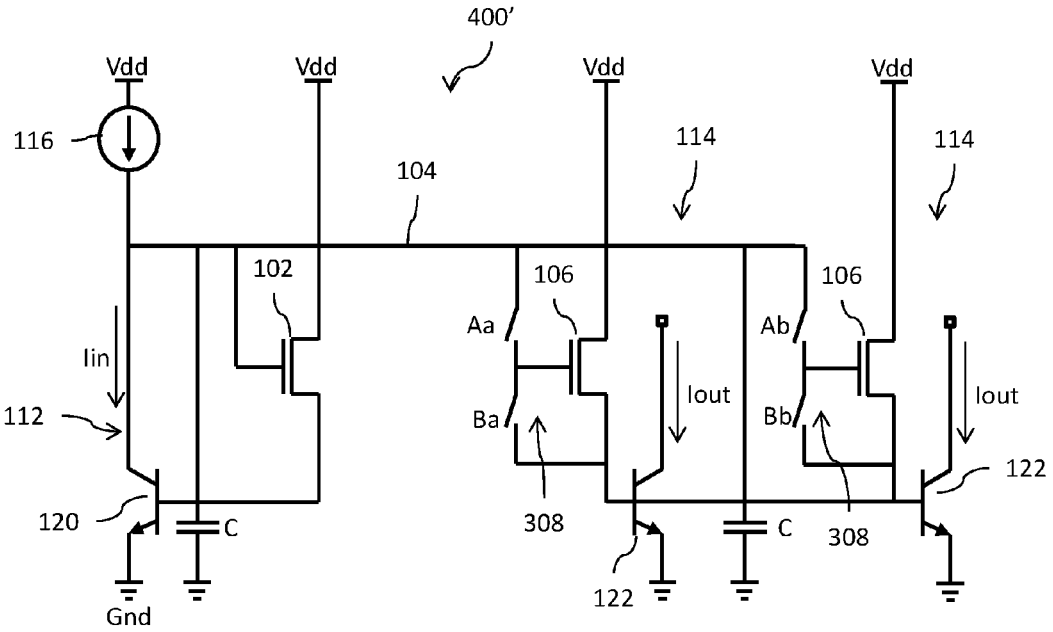

Reference is now made to FIG. 12 showing a circuit diagram for a current mirror circuit 400'. The circuit 400' is substantially similar in design to the circuit 400 of FIG. 11. The circuit 400' differs from the circuit 400 in that there is no transistor common base connection line 108. Nonetheless, the MOSFET device 102 and the MOSFET device 106 function to control substantially equal (i.e., same within +/−2.5%) base voltages for the BIT devices.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A current mirror circuit, comprising:

an input current leg including:

a first bipolar junction transistor (BJT) having a collector terminal configured to receive an input current sourced at a current node; and a first metal oxide semiconductor field effect transistor (MOSFET) having a gate terminal coupled to the current node and a source terminal coupled to a base terminal of the first BJT; and a first output current leg including:

a second BJT having a collector terminal configured to supply an output current; and a second MOSFET having a gate terminal coupled to the current node and a source terminal coupled to a base terminal of the second BJT.

2. The current mirror circuit of claim 1, wherein the base terminal of the first BJT and the base terminal of the second BJT are connected by a circuit line having a parasitic resistance.

3. The current mirror circuit of claim 1, wherein the second BJT is a variable BJT formed by a plurality of BJT devices coupled in parallel and selectively enabled by one or more digital control signals.

4. The current mirror circuit of claim 3, wherein the second MOSFET is coupled to each one of the plurality of BJT devices of said variable BJT.

5. The current mirror of claim 1, further comprising a second output current leg including:

a third BJT having a collector terminal configured to supply a further output current; and a third MOSFET having a gate terminal coupled to the current node and a source terminal coupled to a base terminal of the third BJT.

6. The current mirror of claim 5, wherein the first and second output current legs are connected together at a common output current node.

7. The current mirror of claim 6, further comprising a precharge circuit configured to precharge the common output current node to a precharge voltage.

8. The current mirror of claim 1, further comprising a first switch configured to selectively couple the gate terminal of the second MOSFET to the current node in response to a first control signal.

9. The current mirror of claim 8, further comprising a second switch configured to selectively couple the gate terminal of the second MOSFET to the source terminal of the second MOSFET in response to a second control signal.

10. The current mirror of claim 9, wherein the first and second control signals are non-overlapping.

11. The current mirror circuit of claim 1, wherein the base terminal of the first BJT and the base terminal of the second BJT are connected by a circuit line having a parasitic resistance, and further comprising a third switch configured to selectively couple the base terminal of the second BJT to the circuit line in response to a third control signal.

12. The current mirror of claim 11, further comprising a fourth switch configured to selectively couple the base terminal of the second BJT to the emitter terminal of the second BJT in response to a fourth control signal.

13. The current mirror of claim 12, wherein the third and fourth control signals are non-overlapping.

14. The current mirror of claim 12, further comprising a fifth switch configured to selectively couple the collector terminal of the second BJT to the emitter terminal of the second BJT in response to a fifth control signal.

15. The current mirror of claim 1, wherein the input current leg further includes a first cascode transistor coupled in series with the first BJT to receive said input current sourced at said current node;

wherein the output current leg further includes a second cascode transistor coupled in series with the second BJT; and wherein said first and second cascode transistors are biased by a bias voltage.

16. The current mirror of claim 15, further comprising a sixth switch configured to selectively couple a control terminal of the second cascode transistor to the bias voltage in response to a sixth control signal.

17. The current mirror of claim 16, further comprising a seventh switch configured to selectively couple the control terminal of the second cascode transistor to the second BJT in response to a seventh control signal.

18. The current mirror of claim 17, wherein the sixth and seventh control signals are non-overlapping.

* * * * *